US012637809B2

(12) United States Patent
Uehara et al.

(10) Patent No.: US 12,637,809 B2
(45) Date of Patent: May 26, 2026

(54) OIL-RESISTANT AGENT COMPOSITION

(71) Applicant: DAIKIN INDUSTRIES, LTD., Osaka (JP)

(72) Inventors: Tetsuya Uehara, Osaka (JP); Daisuke Noguchi, Osaka (JP); Norimasa Uesugi, Osaka (JP); Hisako Nakamura, Osaka (JP); Shun Shibata, Osaka (JP); Michio Matsuda, Osaka (JP); Teruyuki Fukuda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 142 days.

(21) Appl. No.: 18/405,370

(22) Filed: Jan. 5, 2024

(65) Prior Publication Data

US 2024/0150965 A1 May 9, 2024

Related U.S. Application Data

(63) Continuation of application No. PCT/JP2022/026877, filed on Jul. 6, 2022.

(30) Foreign Application Priority Data

Jul. 8, 2021 (JP) ..... 2021-113734

(51) Int. Cl.
*D21H 17/34* (2006.01)
*B65D 85/72* (2006.01)
*D21H 21/14* (2006.01)

(52) U.S. Cl.
CPC ..... *D21H 17/34* (2013.01); *B65D 85/72* (2013.01); *D21H 21/14* (2013.01)

(58) Field of Classification Search
USPC ..... 162/168.1
See application file for complete search history.

(56) References Cited

U.S. PATENT DOCUMENTS

| | | | | |
|---|---|---|---|---|
| 2020/0377774 | A1* | 12/2020 | Takahashi | C08F 220/34 |
| 2021/0108371 | A1 | 4/2021 | Oshima et al. | |
| 2021/0164165 | A1 | 6/2021 | Yamamoto et al. | |
| 2021/0214545 | A1 | 7/2021 | Shiotani et al. | |
| 2022/0064851 | A1 | 3/2022 | Tanaka et al. | |
| 2022/0081842 | A1 | 3/2022 | Uehara et al. | |
| 2024/0150965 | A1 | 5/2024 | Uehara et al. | |

FOREIGN PATENT DOCUMENTS

| | | | |
|---|---|---|---|
| JP | 4-106180 | A | 4/1992 |
| JP | 06-330027 | A | 11/1994 |
| JP | 2018-16902 | A | 2/2018 |
| JP | 2019-26746 | A | 2/2019 |
| JP | 7252502 | B2 | 4/2023 |
| WO | 2019/163570 | A1 | 8/2019 |
| WO | 2020/004639 | A1 | 1/2020 |
| WO | 2020/054856 | A1 | 3/2020 |
| WO | 2020/067448 | A1 | 4/2020 |
| WO | 2020/137902 | A1 | 7/2020 |
| WO | 2020/241709 | A1 | 12/2020 |
| WO | 2021/006319 | A1 | 1/2021 |

OTHER PUBLICATIONS

International Search for PCT/JP2022/026877 dated Sep. 13, 2022.
Extended European Search Report dated Jul. 8, 2024, issued in European Application No. 22837716.4.
International Preliminary Report on Patentability dated Jan. 18, 2024 with a translation of the Written Opinion in International Application No. PCT/JP2022/026877.

* cited by examiner

*Primary Examiner* — Jacob T Minskey
(74) *Attorney, Agent, or Firm* — Sughrue Mion, PLLC

(57) ABSTRACT

A paper oil-resistant agent composition containing a hydrocarbon group-containing polymer having a repeating unit formed from a monomer having a hydrocarbon group having 7 to 40 carbon atoms and an NH group-containing group in an amount of 80% by weight or more based on the polymer. Also disclosed is an oil-resistant paper to which the hydrocarbon group-containing polymer in the paper oil-resistant agent composition adheres, a method for producing paper which includes treating paper with the paper oil-resistant composition, and a method for producing molded pulp which includes filling a mold with the paper oil-resistant agent composition and a pulp slurry, and molding the pulp.

13 Claims, No Drawings

OIL-RESISTANT AGENT COMPOSITION

CROSS-REFERENCE TO RELATED APPLICATIONS

The application is a Rule 53(b) Continuation Application of International Application No. PCT/JP2022/026877 filed Jul. 6, 2022, which claims priority from Japanese Application No. 2021-113734 filed Jul. 8, 2021, the respective disclosures of which are incorporated herein by reference in their entirety.

TECHNICAL FIELD

The present disclosure relates to an oil-resistant composition and a paper treated with the oil-resistant composition.

BACKGROUND ART

Food packaging and food containers that are made of paper are required to prevent water and oil contained in food from oozing out. Accordingly, an oil-resistant agent is internally or externally applied to the paper.

Patent Literature 1 (WO2020/054856) discloses a paper oil-resistant agent containing a non-fluorine polymer having (a) a repeating unit formed from an acrylic monomer having a long-chain hydrocarbon group having 7 to 40 carbon atoms, and (b) a repeating unit formed from an acrylic monomer having a hydrophilic group.

Patent Literature 2 (International Publication No. WO 2020/241709) discloses imparting high-temperature oil-resistance by using a non-fluorine polymer and inorganic particles or organic particles.

Patent Literature 3 (JP 2018-16902A) discloses a paper water-repellent agent containing a polymer containing a vinyl monomer having a long-chain alkyl group having 14 or more carbon atoms as a polymerization component.

CITATION LIST

Patent Literature

Patent Literature 1
WO2020/054856
Patent Literature 2
WO2020/241709
Patent Literature 3
JP 2018-16902A

SUMMARY

One embodiment of the present disclosure is as follows:

An oil-resistant composition comprising a hydrocarbon group-containing polymer having a repeating unit formed from a monomer having a hydrocarbon group having 1 to 40 carbon atoms and an NH group-containing group in an amount of 80% by weight or more based on the polymer.

DESCRIPTION OF EMBODIMENT

The present disclosure provides an oil-resistant composition (oil-resistant agent) capable of imparting excellent oil resistance and, as necessary, excellent water resistance to paper.

The oil-resistant composition of the present disclosure contains a hydrocarbon group-containing polymer (i.e., a non-fluorine polymer).

The hydrocarbon group-containing polymer preferably has a repeating unit formed from a monomer having a hydrocarbon group having 1 to 40 carbon atoms and an NH group-containing group in an amount of 80% by weight or more based on the polymer.

In the hydrocarbon group-containing polymer, the NH group-containing group is preferably present between the polymer main chain and the hydrocarbon group having 1 to 40 carbon atoms. The hydrocarbon group-containing polymer is preferably polyolefin, polyacrylic, polyester, polyamide, polycarbonate, or polyurethane.

The hydrocarbon group-containing polymer preferably has a softening point of 65° C. or higher.

The softening point of the hydrocarbon group-containing polymer may be 65° C. or higher, 66° C. or higher, 68° C. or higher, 70° C. or higher, 72° C. or higher, 74° C. or higher, 76° C. or higher, 78° C. or higher, 80° C. or higher, 82° C. or higher, 84° C. or higher, 86° C. or higher, 88° C. or higher, 90° C. or higher, 92° C. or higher, 94° C. or higher, 96° C. or higher, 98° C. or higher, or 100° C. or higher. The upper limit of the softening point of the hydrocarbon group-containing polymer may be 210° C., 200° C., 190° C., 180° C., 150° C., 140° C., 130° C., 120° C., or 110° C.

The "softening point" means the temperature at which the complex viscosity of the polymer is $1.0\times10^4$ as measured by dynamic mechanical analysis (DMA).

The hydrocarbon group-containing polymer is a polymer having a hydrocarbon group having 1 to 40 carbon atoms, and in particular 3 to 40 or 7 to 40 carbon atoms.

The present disclosure imparts excellent oil resistance and water resistance to paper. The paper has excellent oil resistance and water resistance even at high temperatures of 60° C. to 110° C., such as 65° C. to 100° C.

The hydrocarbon group-containing polymer has a hydrocarbon group having 1 to 40 carbon atoms and is polyolefin, polyacrylic, polyester, polyamide, polycarbonate, and polyurethane. The hydrocarbon group-containing polymer is preferably a polymer in which an ethylenic carbon-carbon double bond is polymerized.

The hydrocarbon group-containing polymer preferably has a repeating unit derived from a monomer having a hydrocarbon group having 1 to 40 carbon atoms. An NH group-containing group is preferably present between the polymer main chain and the hydrocarbon group.

The monomer having a hydrocarbon group having 1 to 40 carbon atoms is not limited, but is preferably a monomer having an ethylenic carbon-carbon double bond, and in particular an acrylic monomer.

In the monomer having a hydrocarbon group having 1 to 40 carbon atoms, an NH group-containing group is preferably present between the hydrocarbon group having 1 to 40 carbon atoms and the ethylenic carbon-carbon double bond. Examples of the NH group-containing group include an amide group, a urethane group, a urea group, and a sulfonamide group.

A preferred hydrocarbon group-containing polymer has:

(a) a repeating unit formed of an acrylic monomer having a hydrocarbon group having 1 to 40 carbon atoms and an NH group-containing group, and (b) a repeating unit formed of an acrylic monomer having a hydrophilic group.

Moreover, the hydrocarbon group-containing polymer preferably has a repeating unit formed of (c) a monomer having an ion donating group in addition to the monomers (a) and (b).

The hydrocarbon group-containing polymer may have a repeating unit formed of (d) another monomer in addition to the monomers (a), (b), and (c).

(a) Acrylic Monomer Having Hydrocarbon Group

The acrylic monomer having a hydrocarbon group (a) has a hydrocarbon group having 1 to 40, 3 to 40 or 7 to 40 carbon atoms. The hydrocarbon group having 1 to 40 carbon atoms is preferably a linear or branched hydrocarbon group having 1 to 40 carbon atoms. The number of carbon atoms of the hydrocarbon group preferably 10 to 40, such as 12 to 30, and particularly preferably 15 to 30 since high oil resistance is obtained. Alternatively, the number of carbon atoms of the hydrocarbon group may be 18 to 40 carbon atoms.

The acrylic monomer having a hydrocarbon group (a) is preferably a compound (an acrylate monomer or an acrylamide monomer) represented by formula:

$$CH_2{=}C(-X^1)-C(=O)-Y^1-Z(-Y^2-R^1)_n$$

wherein $R^1$ is each independently a hydrocarbon group having 1 to 40 carbon atoms, $X^1$ is a hydrogen atom, a monovalent organic group, or a halogen atom, $Y^1$ is —O— or —NH—, $Y^2$ is an NH group-containing group, Z is a direct bond or a divalent or trivalent hydrocarbon group having 1 to 5 carbon atoms, and n is 1 or 2.

$X^1$ may be a hydrogen atom, a methyl group, halogen excluding a fluorine atom, a substituted or unsubstituted benzyl group, or a substituted or unsubstituted phenyl group. Examples of $X^1$ include a hydrogen atom, a methyl group, a chlorine atom, a bromine atom, an iodine atom, and a cyano group. $X^1$ is preferably a hydrogen atom, a methyl group, or a chlorine atom. $X^1$ is particularly preferably a hydrogen atom.

$Y^1$ is —O— or —NH—, and preferably —O—.

Z is a direct bond or a divalent or trivalent hydrocarbon group having 1 to 5 carbon atoms. Z may have a linear structure or a branched structure. The number of carbon atoms of Z is preferably 2 to 4, and in particular 2. Specific examples of Z include a direct bond, $-CH_2-$, $-CH_2CH_2-$, $-CH_2CH_2CH_2-$, $-CH_2CH_2CH_2CH_2-$, $-CH_2CH_2CH_2CH_2CH_2-$, $CH_2CH{=}$ having a branched structure, $-CH_2(CH-)CH_2-$ having a branched structure, $-CH_2CH_2CH{=}$ having a branched structure, $-CH_2CH_2CH_2CH_2CH{=}$ having a branched structure, $CH_2CH_2(CH-)CH_2-$ having a branched structure, and $-CH_2CH_2CH_2CH{=}$ having a branched structure. Z is preferably a divalent hydrocarbon group having 1 to 5 carbon atoms.

$Y^2$ is an NH group-containing group (a spacer group). $Y^2$ forms a spacer site that can form a hydrogen bond in the polymer. It is considered that the hydrogen bond is formed by an HN group in the polymer to improve oil resistance. $Y^2$ is preferably an amide group, a urethane group, a urea group, and a sulfonamide group. In other words, the NH group-containing group is preferably $-NH-C(=O)-$, $-C(=O)-NH-$, $-O-C(=O)-NH-$, $-NH-C(=O)-O-$ or $-NH-C(=O)-NH-$, $-NH-S(=O)_2-$, or $-S(=O)_2-NH-$.

n is 1 or 2, and preferably 1.

Preferable examples of the acrylic monomer (a), which is an acrylate monomer having a divalent Z group, include: $CH_2{=}C(-X^1)-C(=O)-O-(CH_2)_n-NH-C(=O)-R^1$, $CH_2{=}C(-X^1)-C(=O)-O-(CH_2)_n-C(=O)-NH-R^1$, $CH_2{=}C(-X^1)-C(=O)-O-(CH_2)_n-O-C(=O)-NH-R^1$, $CH_2{=}C(-X^1)-C(=O)-O-(CH_2)_n-NH-C(=O)-O-R^1$, $CH_2{=}C(-X^1)-C(=O)-O-(CH_2)_n-NH-C(=O)-NH-R^1$, $CH_2{=}C(-X^1)-C(=O)-O-(CH_2)_n-NH-S(=O)_2-R^1$, and $CH_2{=}C(-X^1)-C(=O)-O-(CH_2)_n-S(=O)_2-NH-R^1$. The acrylic monomer (a) is particularly preferably $CH_2{=}C(-X^1)-C(=O)-O-(CH_2)_m-NH-C(=O)-R^1$, wherein $X^1$ and $R^1$ are as defined above, and m is 1 to 5.

Preferable specific examples of the acrylic monomer (a), which is an acrylate monomer having a trivalent Z group, include:

[Formula 1]

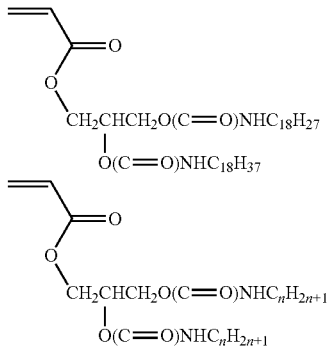

The acrylic monomer (a) can be produced by reacting hydroxyalkyl(meth)acrylate or hydroxyalkyl(meth)acrylamide with alkyl isocyanate. Examples of the alkyl isocyanate include lauryl isocyanate, myristyl isocyanate, cetyl isocyanate, stearyl isocyanate, oleyl isocyanate, and behenyl isocyanate.

Alternatively, the acrylic monomer (a) can also be produced by reacting (meth)acrylate having an isocyanate group in a side chain, such as 2-methacryloyloxyethyl isocyanate, with alkylamine or alkyl alcohol. Examples of the alkylamine include laurylamine, myristylamine, cetylamine, stearylamine, oleylamine, and behenylamine. Examples of the alkyl alcohol include lauryl alcohol, myristyl alcohol, cetyl alcohol, stearyl alcohol, oleyl alcohol, and behenyl alcohol.

The acrylic monomer having a hydrocarbon group (a) is preferably an acrylate in which $X^1$ is a hydrogen atom.

The acrylic monomer (a) is preferably an amide group-containing monomer represented by formula:

$$R^{12}-C(=O)-NH-R^{13}-O-R^{11}$$

wherein $R^{11}$ is an organic residue having an ethylenically unsaturated polymerizable group, $R^{12}$ is a hydrocarbon group having 1 to 40 carbon atoms, and $R^{13}$ is a hydrocarbon group having 1 to 5 carbon atoms.

$R^{11}$ is an organic residue having an ethylenically unsaturated polymerizable group, and is not limited as long as there is a carbon-carbon double bond. Specific examples include organic residues having an ethylenically unsaturated polymerizable group such as $-C(=O)CR^{14}{=}CH_2$, $-CHR^{14}{=}CH_2$, and $-CH_2CHR^{14}{=}CH_2$, and $R^{14}$ is a hydrogen atom or an alkyl group having 1 to 4 carbon atoms. $R^{11}$ may have various organic groups other than the ethylenically unsaturated polymerizable group, e.g., organic groups such as chain hydrocarbons, cyclic hydrocarbons, polyoxyalkylene groups, and polysiloxane groups, and these organic groups may be substituted with various substituents. RH is preferably —C(=O)CR$^{14}$=CH$_2$.

R$^{12}$ is a hydrocarbon group having 1 to 40 carbon atoms and preferably an alkyl group, such as a chain hydrocarbon group or a cyclic hydrocarbon group. Among them, a chain hydrocarbon group is preferable, and a linear saturated hydrocarbon group is particularly preferable. The number of carbon atoms of R$^{12}$ is 1 to 40, preferably 11 to 27, and particularly preferably 15 to 23.

R$^{13}$ is a hydrocarbon group having 1 to 5 carbon atoms, and preferably an alkyl group. The hydrocarbon group having 1 to 5 carbon atoms may be either linear or branched, may have an unsaturated bond, and is preferably linear. The number of carbon atoms of R$^{13}$ is preferably 2 to 4, and particularly preferably 2. R$^{13}$ is preferably an alkylene group.

The amide group-containing monomer may be a monomer having one kind of R$^{12}$ (for example, a compound in which R$^{12}$ has 17 carbon atoms) or a monomer having a combination of multiple kinds of R$^{12}$ (for example, a mixture of a compound in which R$^{12}$ has 17 carbon atoms and a compound in which R$^{12}$ has 15 carbon atoms).

An example of the amide group-containing monomer is carboxylic acid amide alkyl (meth)acrylate.

Specific examples of the amide group-containing monomer include palmitic acid amide ethyl (meth)acrylate, stearic acid amide ethyl (meth)acrylate, behenic acid amide ethyl (meth)acrylate, myristic acid amide ethyl (meth)acrylate, lauric acid amide ethyl (meth)acrylate, isostearic acid ethylamide (meth)acrylate, oleic acid ethylamide (meth)acrylate, tert-butylcyclohexylcaproic acid amide ethyl (meth) acrylate, adamantanecarboxylic acid ethylamide (meth) acrylate, naphthalenecarboxylic acid amide ethyl (meth) acrylate, anthracenecarboxylic acid amide ethyl (meth) acrylate, palmitic acid amide propyl (meth)acrylate, stearic acid amide propyl (meth)acrylate, palmitic acid amide ethyl vinyl ether, stearic acid amide ethyl vinyl ether, palmitic acid amide ethyl allyl ether, stearic acid amide ethyl allyl ether, and mixtures thereof.

The amide group-containing monomer is preferably stearic acid amide ethyl (meth)acrylate. The amide group-containing monomer may be a mixture containing stearic acid amide ethyl (meth)acrylate. In a mixture containing stearic acid amide ethyl (meth)acrylate, the amount of stearic acid amide ethyl (meth)acrylate is, for example, 55 to 99% by weight, preferably 60 to 85% by weight, and more preferably 65 to 80% by weight based on the weight of the entirety of the amide group-containing monomer, and the remainder of the monomer may be, for example, palmitic acid amide ethyl (meth)acrylate.

(b) Acrylic Monomer Having Hydrophilic Group

The acrylic monomer having a hydrophilic group (b) is a monomer different from the monomer (a), and is a hydrophilic monomer. The hydrophilic group is preferably an oxyalkylene group (the number of carbon atoms of the alkylene group is 2 to 6). In particular, the acrylic monomer having a hydrophilic group (b) is preferably polyalkylene glycol mono(meth)acrylate, polyalkylene glycol di(meth) acrylate, and/or polyalkylene glycol mono(meth)acrylamide. Polyalkylene glycol mono(meth)acrylate, polyalkylene glycol di(meth)acrylate, and polyalkylene glycol mono (meth)acrylamide are preferably those represented by general formulae:

$$CH_2{=}CX^2C({=}O){-}O{-}(RO)_n{-}X^3 \quad \text{(b1)},$$

$$CH_2{=}CX^2C({=}O){-}O{-}(RO)_n{-}C({=}O)CX^2{=}CH_2 \quad \text{(b2), or}$$

$$CH_2{=}CX^2C({=}O){-}NH{-}(RO)_n{-}X^3 \quad \text{(b3)}$$

wherein,

X$^2$ is each independently a hydrogen atom or a methyl group,

X$^3$ is each independently is a hydrogen atom or an unsaturated or saturated hydrocarbon group having 1 to 22 carbon atoms, R is an alkylene group having 2 to 6 carbon atoms, and n is an integer of 1 to 90. n may be, for example, 1 to 50, in particular 1 to 30, and especially 1 to 15 or 2 to 15. Alternatively, n may be, for example, 1.

R may be a linear or branched alkylene group such as a group represented by formula —$(CH_2)_x$— or $(CH_2)_{x1}$—$(CH(CH_3))_{x2}$— wherein x1 and x2 are 0 to 6 such as 2 to 5, and the sum of x1 and x2 is 1 to 6; and the order of —$(CH_2)_{x1}$— and —$(CH(CH_3))_{x2}$— is not limited to the formula shown, and may be random.

In —$(RO)_n$—, there may be two or more kinds (such as 2 to 4 kinds, and in particular 2 kinds) of R, and thus —$(RO)_n$— may be a combination of, for example, —$(R^1O)_{n1}$— and —$(R^2O)_{n2}$— wherein R$^1$ and R$^2$ are mutually different and an alkylene group having 2 to 6 carbon atoms, n1 and n2 are a number of 1 or more, and the sum of n1 and n2 is 2 to 90.

R in general formulae (b1), (b2), and (b3) is particularly preferably an ethylene group, a propylene group, or a butylene group. R in general formulae (b1), (b2), and (b3) may be a combination of two or more kinds of alkylene groups. In this case, at least one R is preferably an ethylene group, a propylene group, or a butylene group. Examples of the combination of R include a combination of an ethylene group/a propylene group, a combination of an ethylene group/a butylene group, and a combination of a propylene group/a butylene group. The monomer (b) may be a mixture of two or more kinds. In this case, in at least one monomer (b), R in general formula (b1), (b2), or (b3) is preferably an ethylene group, a propylene group, or a butylene group. Polyalkylene glycol di(meth)acrylate represented by general formula (b2) is not preferably used solely as the monomer (b), and is preferably used in combination with the monomer (b1). In this case as well, the compound represented by general formula (b2) is preferably less than 30% by weight in the monomer (b) used.

Specific examples of the acrylic monomer having a hydrophilic group (b) include, but are not limited to, the following.

$CH_2{=}CHCOO{-}CH_2CH_2O{-}H$
$CH_2{=}CHCOO{-}CH_2CH_2CH_2O{-}H$
$CH_2{=}CHCOO{-}CH_2CH(CH_3)O{-}H$
$CH_2{=}CHCOO{-}CH(CH_3)CH_2O{-}H$
$CH_2{=}CHCOO{-}CH_2CH_2CH_2CH_2O{-}H$
$CH_2{=}CHCOO{-}CH_2CH_2CH(CH_3)O{-}H$
$CH_2{=}CHCOO{-}CH_2CH(CH_3)CH\ 2\ O{-}H$
$CH_2{=}CHCOO{-}CH(CH_3)CH_2CH_2O{-}H$
$CH_2{=}CHCOO{-}CH_2CH(CH_2CH_3)O{-}H$
$CH_2{=}CHCOO{-}CH_2C(CH_3)_2O{-}H$
$CH_2{=}CHCOO{-}CH(CH_2CH_3)CH_2O{-}H$
$CH_2{=}CHCOO{-}C(CH_3)_2CH_2O{-}H$
$CH_2{=}CHCOO{-}CH(CH_3)CH(CH_3)O{-}H$
$CH_2{=}CHCOO{-}C(CH_3)(CH_2CH_3)O{-}H$
$CH_2{=}CHCOO{-}(CH_2CH_2O)_2{-}H$
$CH_2{=}CHCOO{-}(CH_2CH_2O)_4{-}H$
$CH_2{=}CHCOO{-}(CH_2CH_2O)_3{-}H$
$CH_2{=}CHCOO{-}(CH_2CH_2O)_6{-}H$
$CH_2{=}CHCOO{-}(CH_2CH_2O)_3{-}CH_3$
$CH_2{=}CHCOO{-}(CH_2CH_2O)_9{-}CH_3$ $CH_2{=}CHCOO{-}(CH_2CH_2O)_{23}{-}CH_3$
$CH_2{=}CHCOO{-}(CH_2CH_2O)_{90}{-}CH_3$
$CH_2{=}CHCOO{-}(CH_2CH(CH_3)O)_9{-}H$
$CH_2{=}CHCOO{-}(CH_2CH(CH_3)O)_9{-}CH_3$
$CH_2{=}CHCOO{-}(CH_2CH(CH_3)O)_{12}{-}CH_3$
$CH_2{=}CHCOO{-}(CH_2CH_2O)_3{-}(CH_2CH(CH_3)O)_2{-}H$
$CH_2{=}CHCOO{-}(CH_2CH_2O)_3{-}(CH_2CH(CH_3)O)_3{-}CH_3$
$CH_2{=}CHCOO{-}(CH_2CH_2O)_8{-}(CH_2CH(CH_3)O)_6{-}CH_2CH(C_2H_5)C_4H_9$
$CH_2{=}CHCOO{-}(CH_2CH_2O)_{23}{-}OOC(CH_3)C{=}CH_2$
$CH_2{=}CHCOO{-}(CH_2CH_2O)_{20}{-}(CH_2CH(CH_3)O)_5{-}CH_2{-}CH{=}CH_2$
$CH_2{=}CHCOO{-}(CH_2CH_2O)_9{-}H$
$CH_2{=}C(CH_3)COO{-}CH_2CH_2O{-}H$
$CH_2{=}C(CH_3)COO{-}CH_2CH_2CH_2O{-}H$
$CH_2{=}C(CH_3)COO{-}CH_2CH(CH_3)O{-}H$
$CH_2{=}C(CH_3)COO{-}CH(CH_3)CH_2O{-}H$
$CH_2{=}C(CH_3)COO{-}CH_2CH_2CH_2CH_2O{-}H$
$CH_2{=}C(CH_3)COO{-}CH_2CH_2CH(CH_3)O{-}H$
$CH_2{=}C(CH_3)COO{-}CH_2CH(CH_3)CH_2O{-}H$
$CH_2{=}C(CH_3)COO{-}CH(CH_3)CH_2CH_2O{-}H$
$CH_2{=}C(CH_3)COO{-}CH_2CH(CH_2CH_3)O{-}H$
$CH_2{=}C(CH_3)COO{-}CH_2C(CH_3)_2O{-}H$
$CH_2{=}C(CH_3)COO{-}CH(CH_2CH_3)CH_2O{-}H$
$CH_2{=}C(CH_3)COO{-}C(CH_3)_2CH_2O{-}H$
$CH_2{=}C(CH_3)COO{-}CH(CH_3)CH(CH_3)O{-}H$
$CH_2{=}C(CH_3)COO{-}C(CH_3)(CH_2CH_3)O{-}H$
$CH_2{=}C(CH_3)COO{-}(CH_2CH_2O)_2{-}H$
$CH_2{=}C(CH_3)COO{-}(CH_2CH_2O)_4{-}H$
$CH_2{=}C(CH_3)COO{-}(CH_2CH_2O)_3{-}H$
$CH_2{=}C(CH_3)COO{-}(CH_2CH_2O)_6{-}H$
$CH_2{=}C(CH_3)COO{-}(CH_2CH_2O)_9{-}H$
$CH_2{=}C(CH_3)COO{-}(CH_2CH_2O)_3{-}CH_3$
$CH_2{=}C(CH_3)COO{-}(CH_2CH_2O)_9{-}CH_3$
$CH_2{=}C(CH_3)COO{-}(CH_2CH_2O)_{23}{-}CH_3$
$CH_2{=}C(CH_3)COO{-}(CH_2CH_2O)_{93}{-}CH_3$
$CH_2{=}C(CH_3)COO{-}(CH_2CH(CH_3)O)_9{-}H$
$CH_2{=}C(CH_3)COO{-}(CH_2CH(CH_3)O)_9{-}CH_3$
$CH_2{=}C(CH_3)COO{-}(CH_2CH(CH_3)O)_{12}{-}CH_3$
$CH_2{=}C(CH_3)COO{-}(CH_2CH_2O)_5{-}(CH_2CH(CH_3)O)_2{-}H$
$CH_2{=}C(CH_3)COO{-}(CH_2CH_2O)_5{-}(CH_2CH(CH_3)O)_3{-}CH_3$
$CH_2{=}C(CH_3)COO{-}(CH_2CH_2O)_8{-}(CH_2CH(CH_3)O)_6{-}CH_2CH(C_2H_5)C_4H_9$
$CH_2{=}C(CH_3)COO{-}(CH_2CH_2O)_{23}{-}OOC(CH_3)C{=}CH_2$
$CH_2{=}C(CH_3)COO{-}(CH_2CH_2O)_{20}{-}(CH_2CH(CH_3)O)_3{-}CH_2{-}CH{=}CH_2$
$CH_2{=}CH{-}C({=}O){-}NH{-}CH_2CH_2O{-}H$
$CH_2{=}CH{-}C({=}O){-}NH{-}CH_2CH_2CH_2O{-}H$
$CH_2{=}CH{-}C({=}O){-}NH{-}CH_2CH(CH_3)O{-}H$
$CH_2{=}CH{-}C({=}O){-}NH{-}CH(CH_3)CH_2O{-}H$
$CH_2{=}CH{-}C({=}O){-}NH{-}CH_2CH_2CH_2CH_2O{-}H$
$CH_2{=}CH{-}C({=}O){-}NH{-}CH_2CH_2CH(CH_3)O{-}H$
$CH_2{=}CH{-}C({=}O){-}NH{-}CH_2CH(CH_3)CH_2O{-}H$
$CH_2{=}CH{-}C({=}O){-}NH{-}CH(CH_3)CH_2CH_2O{-}H$
$CH_2{=}CH{-}C({=}O){-}NH{-}CH_2CH(CH_2CH_3)O{-}H$
$CH_2{=}CH{-}C({=}O){-}NH{-}CH_2C(CH_3)_2O{-}H$
$CH_2{=}CH{-}C({=}O){-}NH{-}CH(CH_2CH_3)CH_2O{-}H$
$CH_2{=}CH{-}C({=}O){-}NH{-}C(CH_3)_2CH_2O{-}H$
$CH_2{=}CH{-}C({=}O){-}NH{-}CH(CH_3)CH(CH_3)O{-}H$
$CH_2{=}CH{-}C({=}O){-}NH{-}C(CH_3)(CH_2CH_3)O{-}H$
$CH_2{=}CH{-}C({=}O){-}NH{-}(CH_2CH_2O)_2{-}H$
$CH_2{=}CH{-}C({=}O){-}NH{-}(CH_2CH_2O)_4{-}H$
$CH_2{=}CH{-}C({=}O){-}NH{-}(CH_2CH_2O)_5{-}H$
$CH_2{=}CH{-}C({=}O){-}NH{-}(CH_2CH_2O)_6{-}H$
$CH_2{=}CH{-}C({=}O){-}NH{-}(CH_2CH_2O)_9{-}H$
$CH_2{=}CH{-}C({=}O){-}NH{-}(CH_2CH_2O)_5{-}CH_3$
$CH_2{=}CH{-}C({=}O){-}NH{-}(CH_2CH_2O)_9{-}CH_3$
$CH_2{=}CH{-}C({=}O){-}NH{-}(CH_2CH_2O)_{23}{-}CH_3$
$CH_2{=}CH{-}C({=}O){-}NH{-}(CH_2CH_2O)_{90}{-}CH_3$
$CH_2{=}CH{-}C({=}O){-}NH{-}(CH_2CH(CH_3)O)_9{-}H$
$CH_2{=}CH{-}C({=}O){-}NH{-}(CH_2CH(CH_3)O)_9{-}CH_3$
$CH_2{=}CH{-}C({=}O){-}NH{-}(CH_2CH(CH_3)O)_{12}{-}CH_3$
$CH_2{=}CH{-}C({=}O){-}NH{-}(CH_2CH_2O)_3{-}(CH_2CH(CH_3)O)_2{-}H$
$CH_2{=}CH{-}C({=}O){-}NH{-}(CH_2CH_2O)_3{-}(CH_2CH(CH_3)O)_3{-}CH_3$
$CH_2{=}CH{-}C({=}O){-}NH{-}(CH_2CH_2O)_8{-}(CH_2CH(CH_3)O)_6{-}CH_2CH(C_2H_5)C_4H_9$
$CH_2{=}C(CH_3){-}C({=}O){-}NH{-}CH_2CH_2O{-}H$
$CH_2{=}C(CH_3){-}C({=}O){-}NH{-}CH_2CH_2CH_2O{-}H$
$CH_2{=}C(CH_3){-}C({=}O){-}NH{-}CH_2CH(CH_3)O{-}H$
$CH_2{=}C(CH_3){-}C({=}O){-}NH{-}CH(CH_3)CH_2O{-}H$
$CH_2{=}C(CH_3){-}C({=}O){-}NH{-}CH_2CH_2CH_2CH_2O{-}H$
$CH_2{=}C(CH_3){-}C({=}O){-}NH{-}CH_2CH_2CH(CH_3)O{-}H$
$CH_2{=}C(CH_3){-}C({=}O){-}NH{-}CH_2CH(CH_3)CH_2O{-}H$
$CH_2{=}C(CH_3){-}C({=}O){-}NH{-}CH(CH_3)CH_2CH_2O{-}H$
$CH_2{=}C(CH_3){-}C({=}O){-}NH{-}CH_2CH(CH_2CH_3)O{-}H$
$CH_2{=}C(CH_3){-}C({=}O){-}NH{-}CH_2C(CH_3)_2O{-}H$
$CH_2{=}C(CH_3){-}C({=}O){-}NH{-}CH(CH_2CH_3)CH_2O{-}H$
$CH_2{=}C(CH_3){-}C({=}O){-}NH{-}C(CH_3)_2CH_2O{-}H$
$CH_2{=}C(CH_3){-}C({=}O){-}NH{-}CH(CH_3)CH(CH_3)O{-}H$
$CH_2{=}C(CH_3){-}C({=}O){-}NH{-}C(CH_3)(CH_2CH_3)O{-}H$
$CH_2{=}C(CH_3){-}C({=}O){-}NH{-}(CH_2CH_2O)_2{-}H$
$CH_2{=}C(CH_3){-}C({=}O){-}NH{-}(CH_2CH_2O)_4{-}H$
$CH_2{=}C(CH_3){-}C({=}O){-}NH{-}(CH_2CH_2O)_5{-}H$
$CH_2{=}C(CH_3){-}C({=}O){-}NH{-}(CH_2CH_2O)_6{-}H$
$CH_2{=}C(CH_3){-}C({=}O){-}NH{-}(CH_2CH_2O)_9{-}H$
$CH_2{=}C(CH_3){-}C({=}O){-}NH{-}(CH_2CH_2O)_5{-}CH_3$
$CH_2{=}C(CH_3){-}C({=}O){-}NH{-}(CH_2CH_2O)_9{-}CH_3$
$CH_2{=}C(CH_3){-}C({=}O){-}NH{-}(CH_2CH_2O)_{23}{-}CH_3$
$CH_2{=}C(CH_3){-}C({=}O){-}NH{-}(CH_2CH_2O)_{90}{-}CH_3$
$CH_2{=}C(CH_3){-}C({=}O){-}NH{-}(CH_2CH(CH_3)O)_9{-}H$
$CH_2{=}C(CH_3){-}C({=}O){-}NH{-}(CH_2CH(CH_3)O)_9{-}CH_3$
$CH_2{=}C(CH_3){-}C({=}O){-}NH{-}(CH_2CH(CH_3)O)_{12}{-}CH_3$
$CH_2{=}C(CH_3){-}C({=}O){-}NH{-}(CH_2CH_2O)_5{-}(CH_2CH(CH_3)O)_2{-}H$
$CH_2{=}C(CH_3){-}C({=}O){-}NH{-}(CH_2CH_2O)_5{-}(CH_2CH(CH_3)O)_3{-}CH_3$
$CH_2{=}C(CH_3){-}C({=}O){-}NH{-}(CH_2CH_2O)_8{-}(CH_2CH(CH_3)O)_6{-}CH_2CH(C_2H_5)C_4H_9$

The monomer (b) is preferably acrylate or acrylamide in which $X^2$ is a hydrogen atom. In particular, hydroxyethyl acrylate, hydroxypropyl acrylate, hydroxybutyl acrylate, or hydroxyethyl acrylamide is preferable.

(c) Monomer Having Ion Donating Group

The monomer having an ion donating group (c) is a monomer different from the monomer (a) and the monomer (b). The monomer (c) is preferably a monomer having an ethylenic carbon-carbon double bond and an ion donating group. The ion donating group is an anion donating group and/or a cation donating group.

Examples of the monomer having an anion donating group include monomers having a carboxyl group, a sulfonic acid group, or a phosphoric acid group. Specific examples of the monomer having an anion donating group include (meth)acrylic acid, crotonic acid, maleic acid, fumaric acid, itaconic acid, citraconic acid, vinyl sulfonic acid, (meth)allylsulfonic acid, styrenesulfonic acid, phosphoric acid (meth)acrylate, vinylbenzenesulfonic acid, acrylamide tert-butyl sulfonic acid, and salts thereof.

Examples of salts of the anion donating group include alkali metal salts, alkaline earth metal salts, and ammonium salts, such as a methyl ammonium salt, an ethanol ammonium salt, and a triethanol ammonium salt.

In the monomer having a cation donating group, examples of the cation donating group include an amino group and preferably a tertiary amino group and a quaternary amino group. In the tertiary amino group, two groups bonded to the nitrogen atom are the same or different and are preferably an aliphatic group having 1 to 5 carbon atoms (in particular an alkyl group), an aromatic group having 6 to 20 carbon atoms (an aryl group), or an araliphatic group having 7 to 25 carbon atoms (in particular an aralkyl group such as a benzyl group ($C_6H_5$—$CH_2$—)). In the quaternary amino group, three groups bonded to the nitrogen atom are the same or different and are preferably an aliphatic group having 1 to 5 carbon atoms (in particular an alkyl group), an aromatic group having 6 to 20 carbon atoms (an aryl group), or an araliphatic group having 7 to 25 carbon atoms (in particular an aralkyl group such as a benzyl group ($C_6H_5$—$CH_2$—)). In the tertiary and quaternary amino groups, the remaining one group bonded to the nitrogen atom may have a carbon-carbon double bond. The cation donating group may be in the form of a salt.

A cation donating group that is a salt is a salt formed with an acid (an organic acid or an inorganic acid). Organic acids such as carboxylic acids having 1 to 20 carbon atoms (in particular, monocarboxylic acids such as acetic acid, propionic acid, butyric acid, and stearic acid) are preferable. Dimethylaminoethyl (meth)acrylate, diethylaminoethyl (meth)acrylate, and salts thereof are preferable.

Specific examples of the monomer having a cation donating group are as follows.

$CH_2$=$CHCOO$—$CH_2CH_2$—$N(CH_3)_2$ and salts thereof (such as acetate)

$CH_2$=$CHCOO$—$CH_2CH_2$—$N(CH_2CH_3)_2$ and salts thereof (such as acetate)

$CH_2$=$C(CH_3)C_{00}$—$CH_2CH_2$—$N(CH_3)_2$ and salts thereof (such as acetate)

$CH_2$=$C(CH_3)COO$—$CH_2CH_2$—$N(CH_2CH_3)$ 2 and salts thereof (such as acetate)

$CH_2$=$CHC(O)N(H)$—$CH_2CH_2CH_2$—$N(CH_3)_2$ and salts thereof (such as acetate)

$CH_2$=$CHCOO$—$CH_2CH_2$—$N$(—$CH_3$)(—$CH_2$—$C_6H_5$) and salts thereof (such as acetate)

$CH_2$=$C(CH_3)COO$—$CH_2CH_2$—$N$(—$CH_2CH_3$)(—$CH_2$—$C_6H_5$) and salts thereof (such as acetate)

$CH_2$=$CHCOO$—$CH_2CH_2$—$N^+(CH_3)_3Cl^-$ $CH_2$=$CHCOO$—$CH_2CH_2$—$N^+$(—$CH_3$)$_2$(—$CH_2$—$C_6H_5$)$Cl^-$ $CH_2$=$C(CH_3)COO$—$CH_2CH_2$—$N^+(CH_3)_3Cl^-$ $CH_2$=$CHCOO$—$CH_2CH(OH)CH_2$—$N^+(CH_3)_3Cl^-$ $CH_2$=$C(CH_3)COO$—$CH_2CH(OH)CH_2$—$N^+(CH_3)_3Cl^-$ $CH_2$=$C(CH_3)COO$—$CH_2CH(OH)CH_2$—$N^+$(—$CH_2CH_3$)$_2$(—$CH_2$—$C_6H_5$)$Cl^-$ $CH_2$=$C(CH_3)COO$—$CH_2CH_2$—$N^+(CH_3)_3Br^-$ $CH_2$=$C(CH_3)COO$—$CH_2CH_2$—$N^+(CH_3)_3I^-$ $CH_2$=$C(CH_3)COO$—$CH_2CH_2$—$N^+(CH_3)_3O^-SO_3CH_3$ $CH_2$=$C(CH_3)COO$—$CH_2CH_2$—$N^+(CH_3)$(—$CH_2$—$C_6H_5$)$_2Br^-$

The monomer having an ion donating group (c) is preferably methacrylic acid, acrylic acid, and dimethylaminoethyl methacrylate, and more preferably methacrylic acid and dimethylaminoethyl methacrylate.

(d) Another Monomer

Another monomer (d) is a monomer different from the monomers (a), (b), and (c). Examples of such another monomer include ethylene, vinyl acetate, vinyl chloride, vinyl fluoride, halogenated vinyl styrene, α-methylstyrene, p-methylstyrene, polyoxyalkylene mono(meth)acrylate, (meth)acrylamide, diacetone (meth)acrylamide, methylollated (meth)acrylamide, N-methylol (meth)acrylamide, alkyl vinyl ether, halogenated alkyl vinyl ether, alkyl vinyl ketone, butadiene, isoprene, chloroprene, glycidyl (meth) acrylate, aziridinyl (meth)acrylate, benzyl (meth)acrylate, isocyanate ethyl (meth)acrylate, cyclohexyl (meth)acrylate, isobornyl (meth)acrylate, short-chain alkyl (meth)acrylate, maleic anhydride, (meth)acrylate having a polydimethylsiloxane group, and N-vinylcarbazole.

The amount of the repeating unit formed of the monomer (a) (repeating unit (a)) may be 80% by weight or more, 82% by weight or more, 84% by weight or more, 86% by weight or more, 88% by weight or more, 90% by weight or more, 91% by weight or more, 92% by weight or more, 93% by weight or more, 94% by weight or more, or 95% by weight or more based on the hydrocarbon group-containing polymer (or the sum of the repeating unit (a) and the repeating unit (b)).

The amount of the repeating unit formed of the monomer (a)(repeating unit (a)) may be 99% by weight or less, 98% by weight or less, 96% by weight or less, 95% by weight or less, 94% by weight or less, 92% by weight or less, or 90% by weight or less based on the hydrocarbon group-containing polymer (or the sum of the repeating unit (a) and the repeating unit (b)).

The amount of the repeating unit formed of the monomer (b) (repeating unit (b)) may be 0.5 to 15% by weight, 1 to 13% by weight, 3 to 12% by weight, 4 to 11% by weight, 5 to 10% by weight, 6 to 9% by weight, or 7 to 8% by weight based on the hydrocarbon group-containing polymer (or the sum of the repeating unit (a) and the repeating unit (b)).

The amount of the repeating unit formed of the monomer (c) may be 0 to 15% by weight, 0.3 to 10% by weight, 0.5 to 8% by weight, 0.8 to 7% by weight, 1 to 6% by weight, 1.5 to 5% by weight, 1.8 to 4% by weight, or 2 to 3% by weight based on the hydrocarbon group-containing polymer.

The amount of the repeating unit formed of the monomer (d) may be 1 to 10% by weight, 2 to 9% by weight, 3 to 8% by weight, 4 to 7% by weight, or 5 to 6% by weight based on the hydrocarbon group-containing polymer.

The weight average molecular weight of the hydrocarbon group-containing polymer may be 1,000 to 10,000,000 or 100,000,000, preferably 5,000 to 8,000,000 or 80,000,000, and more preferably 10,000 to 4,000,000 or 40,000,000. The weight average molecular weight is a value obtained in terms of polystyrene by gel permeation chromatography.

Herein, "(meth)acryl" means acryl or methacryl. For example, "(meth)acrylate" means acrylate or methacrylate.

From the viewpoint of oil resistance, the hydrocarbon group-containing polymer is preferably a random copolymer rather than a block copolymer.

Polymerization for the hydrocarbon group-containing polymer is not limited, and various polymerization methods can be selected, such as bulk polymerization, solution polymerization, emulsion polymerization, and radiation polymerization. For example, in general, solution polymerization involving an organic solvent, and emulsion polymerization involving water or involving an organic solvent and water in combination, are selected. The hydrocarbon group-containing copolymer after polymerization is diluted with water to be emulsified in water and thus formed into a treatment liquid.

Herein, it is preferable that after polymerization (for example, solution polymerization or emulsion polymerization, preferably solution polymerization), water is added, and then the solvent is removed to disperse the polymer in water. An emulsifier does not need to be added, and a self-dispersive product can be produced.

Herein, it is preferable to use emulsion polymerization. In the same monomer formulation, emulsion polymerization gives a polymer with better high-temperature oil resistance than solution polymerization.

Examples of organic solvents include ketones such as acetone and methyl ethyl ketone, esters such as ethyl acetate and methyl acetate, glycols such as propylene glycol, dipropylene glycol monomethyl ether, N-methyl-2-pyrrolidone (NMP), dipropylene glycol, tripropylene glycol, and low molecular weight polyethylene glycol, and alcohols such as ethyl alcohol and isopropanol.

For example, peroxide, an azo compound, or a persulfate compound can be used as a polymerization initiator. The polymerization initiator is, in general, water-soluble and/or oil-soluble.

Specific examples of the oil-soluble polymerization initiator preferably include 2,2'-azobis(2-methylpropionitrile), 2,2'-azobis(2-methylbutyronitrile), 2,2'-azobis(2,4-dimethylvaleronitrile), 2,2'-azobis(2,4-dimethyl-4-methoxyvaleronitrile), 1,1'-azobis(cyclohexan-1-carbonitrile), dimethyl 2,2'-azobis(2-methylpropionate), 2,2'-azobis(2-isobutyronitrile), benzoyl peroxide, di-tert-butyl peroxide, lauryl peroxide, cumene hydroperoxide, t-butyl peroxypivalate, diisopropyl peroxydicarbonate, and t-butyl perpivalate.

Specific examples of the water-soluble polymerization initiator preferably include 2,2'-azobisisobutylamidine dihydrochloride, 2,2'-azobis(2-methylpropionamidine) dihydrochloride, 2,2'-azobis[2-(2-imidazolin-2-yl)propane] hydrochloride, 2,2'-azobis[2-(2-imidazolin-2-yl)propane] sulfate hydrate, 2,2'-azobis[2-(5-methyl-2-imidazolin-2-yl)propane] hydrochloride, potassium persulfate, barium persulfate, ammonium persulfate, and hydrogen peroxide.

The polymerization initiator is used in the range of 0.01 to 5 parts by weight based on 100 parts by weight of the monomers.

In order to regulate the molecular weight, a chain transfer agent such as a mercapto group-containing compound may be used, and specific examples thereof include 2-mercaptoethanol, thiopropionic acid, and alkyl mercaptan. The mercapto group-containing compound is used in the range of 10 parts by weight or less, or 0.01 to 5 parts by weight, based on 100 parts by weight of the monomers.

Specifically, the hydrocarbon group-containing polymer can be produced as follows.

In solution polymerization, a method is employed that involves dissolving the monomers in an organic solvent, performing nitrogen purge, then adding a polymerization initiator, and heating and stirring the mixture, for example, in the range of 40 to 120° C. for 1 to 10 hours. The polymerization initiator may be, in general, an oil-soluble polymerization initiator.

The organic solvent is inert to and dissolves the monomers, and examples include ketones such as acetone and methyl ethyl ketone, esters such as ethyl acetate and methyl acetate, glycols such as propylene glycol, dipropylene glycol monomethyl ether, N-methyl-2-pyrrolidone (NMP), dipropylene glycol, tripropylene glycol, and low molecular weight polyethylene glycol, alcohols such as ethyl alcohol and isopropanol, and hydrocarbon solvents such as n-heptane, n-hexane, n-octane, cyclohexane, methylcyclohexane, cyclopentane, methylcyclopentane, methylpentane, 2-ethylpentane, isoparaffin hydrocarbon, liquid paraffin, decane, undecane, dodecane, mineral spirit, mineral turpen, and naphtha. Preferable examples of the solvent include acetone, chloroform, HCHC 225, isopropyl alcohol, pentane, hexane, heptane, octane, cyclohexane, benzene, toluene, xylene, petroleum ether, tetrahydrofuran, 1,4-dioxane, methyl ethyl ketone, methyl isobutyl ketone, ethyl acetate, butyl acetate, 1,1,2,2-tetrachloroethane, 1,1,1-trichloroethane, trichloroethylene, perchloroethylene, tetrachlorodifluoroethane, trichlorotrifluoroethane, N-methyl-2-pyrrolidone (NMP), and dipropylene glycol monomethyl ether (DPM). The organic solvent is used in the range of 50 to 2,000 parts by weight, such as 50 to 1,000 parts by weight, based on total 100 parts by weight of the monomers.

In emulsion polymerization, a method is employed that involves emulsifying the monomers in water in the presence of an emulsifier, performing nitrogen purge, then adding a polymerization initiator, and stirring the mixture in the range of 40 to 80° C. for 1 to 10 hours for polymerization. As the polymerization initiator, a water-soluble polymerization initiator such as 2,2'-azobisisobutylamidine dihydrochloride, 2,2'-azobis(2-methylpropionamidine) hydrochloride. 2,2'-azobis[2-(2-imidazolin-2-yl)propane] hydrochloride, 2,2'-azobis[2-(2-imidazolin-2-yl)propane] sulfate hydrate, 2,2'-azobis[2-(5-methyl-2-imidazolin-2-yl)propane] hydrochloride, potassium persulfate, barium persulfate, ammonium persulfate, or hydrogen peroxide; or an oil-soluble polymerization initiator such as 2,2'-azobis(2-methylpropionitrile), 2,2'-azobis(2-methylbutyronitrile), 2,2'-azobis(2,4-dimethylvaleronitrile), 2,2'-azobis(2,4-dimethyl-4-methoxyvaleronitrile), 1,1'-azobis(cyclohexan-1-carbonitrile), dimethyl 2,2'-azobis(2-methylpropionate), 2,2'-azobis(2-isobutyronitrile), benzoyl peroxide, di-tert-butyl peroxide, lauryl peroxide, cumene hydroperoxide, t-butyl peroxypivalate, diisopropyl peroxydicarbonate, or t-butyl perpivalate is used. The polymerization initiator is used in the range of 0.01 to 10 parts by weight based on 100 parts by weight of the monomers.

In order to obtain a water dispersion of the polymer, that has excellent stability when being left to stand, it is desirable that the monomers are formed into fine particles in water by using an emulsifying apparatus capable of applying strong crushing energy such as a high-pressure homogenizer or an ultrasonic homogenizer, and polymerized by using an oil-soluble polymerization initiator. Various anionic, cationic, or nonionic emulsifiers can be used as emulsifiers, and are used in the range of 0.5 to 20 parts by weight based on 100 parts by weight of the monomers. An anionic and/or nonionic and/or cationic emulsifier is preferably used. When the monomers are not completely compatible, a compatibilizer such as a water-soluble organic solvent or a low molecular weight monomer that causes the monomers to be sufficiently compatible is preferably added. By adding a compatibilizer, emulsifiability and copolymerizability can be increased.

Examples of the water-soluble organic solvent include acetone, propylene glycol, dipropylene glycol monomethyl ether (DPM), dipropylene glycol, tripropylene glycol, ethanol, N-methyl-2-pyrrolidone (NMP), 3-methoxy-3-methyl-1-butanol, or isoprene glycol, and the water-soluble organic solvent may be used in the range of 1 to 50 parts by weight, such as 10 to 40 parts by weight, based on 100 parts by weight of water. By adding NMP or DPM or 3-methoxy-3-methyl-1-butanol or isoprene glycol (a preferable amount is, for example, 1 to 20% by weight, and particularly 3 to 10% by weight, based on the composition), the stability of the composition (in particular, the emulsion) is increased. Examples of the low molecular weight monomer include methyl methacrylate, glycidyl methacrylate, and 2,2,2-trifluoroethyl methacrylate, and the low molecular weight monomer may be used in the range of 1 to 50 parts by weight, such as 10 to 40 parts by weight, based on total 100 parts by weight of the monomers.

The oil-resistant composition is preferably in the form of a solution, an emulsion, or an aerosol. The oil-resistant composition contains a hydrocarbon group-containing polymer and a medium (for example, a liquid medium such as an organic solvent and water). The oil-resistant composition is preferably a water dispersion of the hydrocarbon group-containing polymer.

In the oil-resistant composition, the concentration of the hydrocarbon group-containing polymer may be, for example, 0.01 to 50% by weight.

The ionic charge density of the oil-resistant composition may be −5,000 μeq/g or more, −2,500 μeq/g or more, −1,500 μeq/g or more, −500 μeq/g or more, 0 μeq/g or more, 100 μeq/g or more, or 200 μeq/g or more, and is preferably −2,500 μeq/g or more, and more preferably −400 μeq/g or more, such as 0 μeq/g or more. The ionic charge density of the oil-resistant composition may be 7,500 μeq/g or less, 5,000 μeq/g or less, 2,500 μeq/g or less, 1,000 μeq/g or less, 500 μeq/g or less, 350 μeq/g or less, 300 μeq/g or less, or 250 μeq/g or less, and is preferably 5,000 μeq/g or less, and more preferably 800 μeq/g or less, such as 300 μeq/g or less. In particular, the ionic charge density of the oil-resistant composition is preferably −2,500 to 5,000 μeq/g, and more preferably −400 to 800 μeq/g (such as 210 μeq/g, 250 μeq/g, or 300 μeq/g). The ionic charge density of the oil-resistant composition can be measured by, for example, the following method.

<Measurement of Ionic Charge Density>

The anionic demand of a 0.1 g/L aqueous sample solution is measured with a particle charge analyzer (MUTEK PCD-04, manufactured by BTG) using a 1/1000 standardized potassium polyvinylsulfonate solution to calculate the ionic charge density (cationic charge density) from the following formula (1). Alternatively, the cationic demand is similarly measured using a polydiallyldimethylammonium chloride solution instead of potassium polyvinylsulfonate to calculate the ionic charge density (anionic charge density) from the following formula (1).

[Expression 1]

$$\text{Ionic charge density}(\mu eq/g)=A/B \quad (1)$$

A: Cationic demand or anionic demand (μeq/L)

B: Sample solution concentration (g/L)

The organic solvent in the solution of the polymer can be removed by heating the polymer solution (preferably under reduced pressure) (for example, to 30° C. or higher, such as 50 to 120° C.)

The oil-resistant composition can be used to treat a paper substrate (for example, surface treatment and internal treatment).

The oil-resistant composition can be applied to the treatment target by a conventionally known method. The oil-resistant composition is usually dispersed and diluted in an organic solvent or water, adhered to the front side of the treatment target by a known method such as dip application, spray application, or foam application, and then dried (surface treatment). Alternatively, the oil-resistant composition is added to a pulp slurry and dehydrated, molded, and then dried by a known method (internal treatment).

Examples of the treatment-target paper substrate include paper, a container made of paper, and a molded article made of paper (for example, molded pulp).

The hydrocarbon group-containing polymer of the present disclosure is favorably adhered to the paper substrate.

Paper can be produced by a conventionally known papermaking method. An internal treatment method in which the oil-resistant composition is added to a pulp slurry before papermaking, or an external treatment method in which the oil-resistant composition is applied to paper after papermaking, can be used. The method of treatment with the oil-resistant composition in the present disclosure is preferably an internal treatment method.

The size press in the external treatment method can also be divided according to the application method as follows.

One application method is the so-called pond two roll sizing press in which an application liquid (sizing liquid) is supplied to the nip formed by passing paper between two rubber rolls to form a coating liquid reservoir called pond, and the sizing liquid is applied onto both sides of the paper by passing the paper through the coating liquid reservoir. Other application method are the gate-roll type in which the sizing liquid is applied by a surface-transfer type, and the rod-metallizing sizing press. In the pond two roll sizing press, the sizing liquid easily penetrates into the inside of the paper, while in the surface-transfer type, components of the sizing liquid tend to stay on the front side of the paper. In the surface-transfer type, an application layer tends to stay on the front side of the paper and an oil-resistant layer formed on the front side is more than that in the pond two roll sizing press.

In the present disclosure, oil-resistance can be imparted to paper even in the case of using the former, pond two roll sizing press.

Paper thus treated, after rough drying at room temperature or high temperature, is optionally subjected to a heat treatment that can have a temperature range of up to 300° C., such as up to 200° C., and in particular 80° C. to 180° C., depending on the properties of the paper, and thus shows excellent oil resistance and water resistance.

The present disclosure can be used in gypsum board base paper, coated base paper, wood containing paper, commonly used liner and corrugating medium, neutral machine glazed paper, neutral liner, rustproof liner and metal laminated paper, kraft paper, and the like. The present disclosure can also be used in neutral printing writing paper, neutral coated base paper, neutral PPC paper, neutral heat sensitive paper, neutral pressure sensitive base paper, neutral inkjet paper, and neutral communication paper.

A pulp raw material to be used may be any of bleached or unbleached chemical pulp such as kraft pulp or sulfite pulp, bleached or unbleached high yield pulp such as ground pulp, mechanical pulp, or thermomechanical pulp, waste paper pulp such as waste newspaper, waste magazine, waste corrugated cardboard, or waste deinked paper. A mixture of the above pulp raw material and synthetic fiber of asbestos, polyamide, polyimide, polyester, polyolefin, polyvinyl alcohol, or the like can be used as well.

A sizing agent can be added to improve the water resistance of paper. Examples of the sizing agent include cationic sizing agents, anionic sizing agents, and rosin-based sizing agents (such as acidic rosin-based sizing agents or neutral rosin-based sizing agents). The amount of the sizing agent may be 0.01 to 5% by weight based on the pulp.

As a paper-making agent, additives used in the production of paper such as paper strength additives, such as starch, modified starch, carboxymethylcellulose, and polyamide-polyamine-epichlorohydrin resin, flocculants, fixing agents, yield improvers, dyes, fluorescent dyes, slime control agents, and antifoaming agents can be used as necessary in paper to the extent that they are usually used. It is preferable to use starch and modified starch.

If necessary, the oil-resistant composition can be applied to paper using starch, polyvinyl alcohol, dye, coating color, anti-slip agent and the like by a size press, a gate roll coater, a bill blade coater, a calendar and the like.

In the external addition, the amount of the hydrocarbon group-containing polymer contained in the oil-resistant layer is preferably 0.01 to 2.0 g/m$^2$, and particularly 0.1 to 1.0 g/m$^2$. The oil-resistant layer is preferably formed by the oil-resistant composition and starch and/or modified starch. The solid content of the oil-resistant composition for paper in the oil-resistant layer is preferably 2 g/m$^2$ or less.

In the internal addition, the oil-resistant composition is preferably mixed with the pulp such that the amount of the oil-resistant composition is 0.01 to 50 parts by weight or 0.01 to 30 parts by weight, such as 0.01 to 10 parts by weight, particularly 0.2 to 5.0 parts by weight, based on 100 parts by weight of the pulp forming the paper.

In the external and internal addition, the weight ratio of starch and modified starch to the hydrocarbon group-containing polymer may be 10:90 to 98:2.

Oil resistance can also be imparted to the paper through the so-called pond two roll sizing press treatment in which a treatment liquid is pooled between the rolls and the base paper is passed through the treatment liquid between the rolls at any roll speed and nip pressure.

The hydrocarbon group-containing polymer may be nonionic, cationic, anionic, or amphoteric. In the external treatment, the paper substrate may contain additives such as sizing agents, paper strength additives, flocculants, retention aids, or coagulants. The additives may be nonionic, cationic, anionic, or amphoteric. The ionic charge density of the additives may be −10,000 to 10,000 μeq/g, preferably −4,000 to 8,000 μeq/g, and more preferably −1,000 to 7,000 μeq/g. The additives (solids or active components) such as sizing agents, paper strength additives, flocculants, retention aids, or coagulants can be used in an amount of generally 0.1 to 10% by weight (for example, 0.2 to 5.0% by weight) based on the pulp. In the case of a paper substrate containing cationic additives (such as sizing agents, paper strength additives, flocculants, retention aids, or coagulants), the oil-resistant composition is preferably anionic.

In the internal treatment, a pulp slurry having a pulp concentration of 0.1 to 5.0% by weight (such as 0.3 to 4.0% by weight) is preferably formed into paper. An additive (such as a sizing agent, a paper strength additive, a flocculant, a retention aid, or a coagulant) and the hydrocarbon group-containing polymer can be added to the pulp slurry. Since the pulp is generally anionic, at least one of the additive and the hydrocarbon group-containing polymer is preferably cationic or amphoteric such that the additive and the hydrocarbon group-containing polymer are favorably anchored to paper. A combination of a cationic or amphoteric additive and an anionic hydrocarbon group-containing polymer, a combination of an anionic additive and a cationic or amphoteric hydrocarbon group-containing polymer, and a combination of a cationic or amphoteric additive and hydrocarbon group-containing polymer are preferably used. It is more preferable to make paper with an ionic charge density of additives constituting a sizing agent, a paper strength additive, a flocculant, a retention aid, or a coagulant of −1,000 to 7,000 μeq/g, and it is even more preferable to make paper with an ionic charge density of 100 to 1,000 μeq/g (for example, 330 μeq/g, 420 μeq/g, or 680 μeq/g).

Examples of the additives (such as, sizing agents, paper strength additives, flocculants, retention aids, or coagulants) are alkyl ketene dimers, alkenyl succinic anhydrides, styrene-based polymers (styrene/maleic acid-based polymers, styrene/acrylic acid-based polymers), urea-formaldehyde polymers, polyethyleneimines, melamine-formaldehyde polymers, polyamide amine-epichlorohydrin polymers, polyacrylamide polymers, polyamine polymers, polydiallyldimethylammonium chlorides, alkylamine/epichlorohydrin condensates, condensates of alkylene dichloride and polyalkylene polyamine, dicyandiamide-formalin condensates, dimethyl diallyl ammonium chloride polymers, and olefin/maleic anhydride polymers.

Examples of the polyacrylamide polymer include a nonionic polyacrylamide polymer, an anionic polyacrylamide polymer, and an amphoteric polyacrylamide polymer.

Oil-resistant compositions are mixed into a substrate, such as resin or paper, to impart oil resistance to the substrate.

When the oil-resistant composition is an internal treatment agent, it can be added to a resin, such as a thermoplastic resin, to impart oil resistance to the resin. When a formed article of resin is produced, the oil-resistant composition can be used.

A polymer is obtained by removing a liquid medium or a liquid medium and an emulsifier from a liquid (solution or dispersion) containing the polymer. For example, the polymer can be obtained by reprecipitating a dispersion (aqueous dispersion liquid or organic solvent dispersion) of the polymer with water or an organic solvent and then drying the dispersion.

For example, a formed article can be produced by a production method including mixing a resin and a polymer to obtain a resin composition and molding the resin composition. The formed article is preferably produced by melt kneading using an extruder or the like.

In general, thermoplastics and polymers are miscibility in the molten state. The kneading can be carried out by a conventionally known method, for example, a single-screw extruder, a twin-screw extruder, and a roll. The resin composition thus obtained is molded by, for example, extrusion forming, injection molding, compression molding, blow molding, and pressing. The resin composition is molded into formed articles of various shapes. The formed articles obtained may be further subjected to a heat treatment in an oven, a drying oven, or the like, after the molding process. The formed articles may be single layered or multi-layered with 2 to 10 layers, for example, 3 to 5 layers.

The substrate may be paper, and in particular molded pulp.

The molded pulp can be produced by filling a mold with a pulp slurry to which an oil-resistant composition is added, and then molding the pulp by allowing water to permeate to the outside of the mold. Alternatively, injection molding may be used as the molding.

The molded pulp can be produced by filling the cavity of the water-permeable mold for the molded pulp with a paper-making liquid and then molding the pulp by allowing water to permeate to the outside of the mold. A method of allowing water in the pulp slurry to permeate to the outside of the mold includes a method in which water is allowed to permeate naturally at ambient pressure and a method in which water is forced to permeate by applying a reduced pressure to the outside of the mold. In injection molding, a molding material containing pulp, starch, water, and an oil-resistant composition can be injection-molded to obtain a three-dimensional structure (molded pulp).

The electrical conductivity of the pulp slurry (to which oil-resistant composition is added) is preferably 0.1 to 2,000 μS/cm, 0.1 to 1,000 μS/cm, 1 to 800 μS/cm, or 10 to 500 μS/cm. When the electrical conductivity is within this range, high oil-resistance can be obtained. The electrical conductivity can be measured using, for example, LAQUAtwin AS-EC-33 manufactured by As One Corporation.

The pH of the pulp slurry is preferably 4 to 9, more preferably 5 to 8, and even more preferably 6 to 7. Within this range, the pulp slurry may have high oil-resistance.

The hardness of water used in the pulp slurry is preferably 5,000 ppm or less, more preferably 3,000 ppm or less, particularly preferably 1,000 ppm or less, and especially preferably 500 ppm or less. Within this range, the pulp slurry may have high oil-resistance.

The formed articles can be used in applications where thermoplastic resins are used, especially in applications where it is preferable to have excellent ease of wiping off stains and excellent scratch resistance. The applications of the formed articles include automobiles (exterior and interior parts)(such as bumper, instrumental panel, and door trim), household electric appliances (such as washing machine and refrigerator)(for example, housing, and door, tray, and vegetable compartment container in refrigerator), various types of cases, buildings (interior and parts)(such as handrails, wallpapers, desks, chairs, toilet seat and toilet seat cover, and bathtub), electronic device (such as smartphone housing), drains, pipes, tableware, floor materials, gasoline tanks, fuel hoses, and OA device. Among them, automobile interior parts, household electric appliance interior parts, and buildings are more preferable.

It is preferable to add an oil-resistant composition to a thermoplastic resin and mix the oil-resistant composition and the thermoplastic resin (internal treatment).

In the present disclosure, an article to be treated is treated with an oil-resistant composition. The "treatment" means that an oil-resistant compositional agent is applied to the treatment target by dipping, spraying, painting, mixing, adding, or the like. Through the treatment, a hydrocarbon group-containing polymer, which is an active component of the oil-resistant composition, permeates into and/or adheres to the front side of treatment target. A hydrocarbon group-containing polymer adheres to the inside and/or the front side of the treatment target.

When treatment target is, for example, a pulp slurry or thermoplastic resin, the treatment causes the hydrocarbon group-containing polymer, which is an active component of the oil-resistant composition, to adhere to the inside and/or the front side of the treatment target.

EXAMPLES

Next, the present disclosure will now be described in detail by way of Examples, Comparative Examples, and Test Examples. However, the description of these does not limit the present disclosure.

Below, a part, %, and a ratio indicate a part by weight, % by weight, and a weight ratio, respectively, unless otherwise specified.

The test methods used below are as follows.

[Softening Point]

The softening point of the polymer was determined by dynamic mechanical analysis (DMA).

The water dispersion of the polymer was dried in an oven at about 130° C. for 30 minutes to obtain a sample copolymer for measurement. In the case of the emulsion polymerization liquid, 10 g of the water dispersion was dispersed in 20 g of isopropyl alcohol and centrifuged at 14,000 rpm for 60 minutes to separate the polymer from the emulsifier to obtain a sample copolymer for measurement. The complex viscosity ($\eta^*$) of the polymer was measured by a dynamic mechanical analyzing device RHEOSOL-G3000 (manufactured by UBM Corporation) at a temperature-increasing rate of 1° C./min. The temperature at which the complex viscosity was $1.0\times10^4$ was defined as the softening point.

[High-Temperature Oil Resistance]

First, 100 ml of an evaluation liquid (corn oil) at 65° C. or 80° C. was poured into a molded pulp product molded into a container shape, the molded pulp product was left to stand still for 30 minutes, then the evaluation liquid was discarded, and the extent of impregnation of the molded pulp product (the container) with the evaluation liquid was visually evaluated according to the following criteria.

- 4: Almost no oil stains on the inside of the bottom of the container
- 3: No oil stains on the outside of the bottom of the container
- 2: Oil stains recognized on less than 5% of the outside area of the bottom of the container
- 1: Oil stains recognized on 5% or more and less than 50% of the outside area of the bottom of the container
- 0: Oil stains recognized on 50% or more of the outside area of the bottom of the container

[High-Temperature Water Resistance]

First, 100 ml of an evaluation liquid at 100° C. was poured into a molded pulp product molded into a container shape, the molded pulp product was left to stand still for 30 minutes, then the evaluation liquid was discarded, and the extent of impregnation of the molded pulp product (the container) with the evaluation liquid was visually evaluated according to the following criteria.

- 4: Almost no liquid stains on the inside of the bottom of the container
- 3: No liquid stains on the outside of the bottom of the container
- 2: Liquid stains recognized on less than 5% of the outside area of the bottom of the container
- 1: Liquid stains recognized on 5% or more and less than 50% of the outside area of the bottom of the container
- 0: Liquid stains recognized on 50% or more of the outside area of the bottom of the container

Synthesis Example 1

A 1 L polyethylene container was charged with 90 parts of stearic acid amide-ethyl acrylate, 3 parts of dimethylaminoethyl methacrylate (DM), 7 parts of hydroxybutyl acrylate (HBA), 370 parts of pure water, 1.1 parts of acetic acid, and 10 parts of alkyl bis(2-hydroxyalkyl)methylammonium chloride, heated to 80° C., stirred with a homomixer for 1 minute at 2,000 rpm, and then emulsified and dispersed with ultrasonic waves for 15 minutes. The emulsified dispersion was transferred to a 1,000 cc four neck flask equipped with a nitrogen introducing tube, a thermometer, a stirring bar, and a reflux tube. After nitrogen purge, 1 part of 2,2'-azobis (2-methylpropionamidine) dihydrochloride was added and reacted at 60° C. for 4 hours to obtain an aqueous dispersion liquid of the polymer. Thereafter, pure water was added to prepare a water dispersion having a solid content concentration of 20% by weight. The water dispersion had an ionic charge density of 250 μeq/g.

Synthesis Example 2

A 1 L polyethylene container was charged with 90 parts of stearic acid amide-ethyl acrylate, 3 parts of dimethylaminoethyl methacrylate (DM), 7 parts of hydroxybutyl acrylate (HBA), 290 parts of pure water, 0.8 parts of acetic acid, 7 parts of alkyl bis(2-hydroxyalkyl)methylammonium chloride, and 3 parts of polyoxyethylene alkyl ether, heated to 80° C., stirred with a homomixer for 1 minute at 2,000 rpm, and then emulsified and dispersed with ultrasonic waves for 15 minutes. The emulsified dispersion was transferred to a 1,000 cc four neck flask equipped with a nitrogen introducing tube, a thermometer, a stirring bar, and a reflux tube. After nitrogen purge, 1 part of 2,2'-azobis(2-methylpropionamidine) dihydrochloride was added and reacted at 60° C. for 4 hours to obtain an aqueous dispersion liquid of the polymer. Thereafter, pure water was added to prepare a water dispersion having a solid content concentration of 25% by weight. The water dispersion had an ionic charge density of 230 μeq/g.

Synthesis Example 3

A 500 mL four neck flask equipped with a nitrogen introducing tube, a thermometer, a stirring bar, and a reflux tube was charged with 90 parts of stearic acid amide-ethyl acrylate, 3 parts of dimethylaminoethyl methacrylate (DM), 7 parts of hydroxybutyl acrylate (HBA), and 100 parts of methyl ethyl ketone (MEK). After nitrogen purge, 0.9 parts of t-butylperoxy pivalate was added and reacted at 65° C. for 12 hours to obtain a copolymer-containing solution of the polymer.

As a post-treatment, 71 g of a 0.4% aqueous acetic acid solution was added to 50 g of the resulting copolymer solution and dispersed, then the mixture was heated by using an evaporator to distill off MEK under reduced pressure, and thus a light brown copolymer-water dispersion liquid (the content of the volatile organic solvent was 1% by weight or less) was obtained. Thereafter, pure water was added to prepare a water dispersion having a solid content concentration of 20% by weight. The water dispersion had an ionic charge density of 210 μeq/g.

Synthesis Example 4

A 1 L polyethylene container was charged with 90 parts of stearic acid amide-ethyl acrylate, 3 parts of dimethylaminoethyl methacrylate (DM), 7 parts of hydroxybutyl acrylate (HBA), 290 parts of pure water, 0.8 parts of acetic acid, and 7 parts of alkyl dimethylbenzyl ammonium chloride, and 10 parts of polyoxyethylene alkyl ether, heated to 80° C., stirred with a homomixer for 1 minute at 2,000 rpm, and then emulsified and dispersed with ultrasonic waves for 15 minutes. The emulsified dispersion was transferred to a 1,000 cc four neck flask equipped with a nitrogen introducing tube, a thermometer, a stirring bar, and a reflux tube. After nitrogen purge, 1 part of 2,2'-azobis(2-methylpropionamidine) dihydrochloride was added and reacted at 60° C. for 4 hours to obtain an aqueous dispersion liquid of the polymer. Thereafter, pure water was added to prepare a water dispersion having a solid content concentration of 25% by weight. The water dispersion had an ionic charge density of 220 μeq/g.

Comparative Synthesis Example 1

A 1 L polyethylene container was charged with 78 parts of stearic acid amide-ethyl acrylate, 6 parts of dimethylaminoethyl methacrylate (DM), 16 parts of hydroxybutyl acrylate (HBA), 370 parts of pure water, 2.2 parts of acetic acid, and 10 parts of alkyl bis(2-hydroxyalkyl)methylammonium chloride, heated to 80° C., stirred with a homomixer for 1 minute at 2,000 rpm, and then emulsified and dispersed with ultrasonic waves for 15 minutes. The emulsified dispersion was transferred to a 1,000 cc four neck flask equipped with a nitrogen introducing tube, a thermometer, a stirring bar, and a reflux tube. After nitrogen purge, 1 part of 2,2'-azobis (2-methylpropionamidine) dihydrochloride was added and reacted at 60° C. for 4 hours to obtain an aqueous dispersion liquid of the polymer. Thereafter, pure water was added to prepare a water dispersion having a solid content concentration of 20% by weight. The water dispersion had an ionic charge density of 370 μeq/g.

Comparative Synthesis Example 2

A 500 mL four neck flask equipped with a nitrogen introducing tube, a thermometer, a stirring bar, and a reflux tube was charged with 78 parts of stearic acid amide-ethyl acrylate, 6 parts of dimethylaminoethyl methacrylate (DM), 16 parts of hydroxybutyl acrylate (HBA), and 100 parts of methyl ethyl ketone (MEK). After nitrogen purge, 0.9 parts of t-butylperoxy pivalate was added and reacted at 65° C. for 12 hours to obtain a copolymer-containing solution of the polymer.

As a post-treatment, 142 g of a 0.4% aqueous acetic acid solution was added to 50 g of the resulting copolymer solution and dispersed, then the mixture was heated by using an evaporator to distill off MEK under reduced pressure, and thus a light brown copolymer-water dispersion liquid (the content of the volatile organic solvent was 1% by weight or less) was obtained. Thereafter, pure water was added to prepare a water dispersion having a solid content concentration of 20% by weight. The water dispersion had an ionic charge density of 350 μeq/g.

Example 1

To a freeness (Canadian Freeness) of 550 cc, 2,000 g of a 0.5% by weight of the water dispersion of a mixture of 70 parts of beaten leaf bleached kraft pulp and 30 parts of needle bleached kraft pulp was added with contiguous stirring. Next, 0.3 g of a 5% solid aqueous solution of alkyl ketene dimer (AKD) (Hercon® 79, manufactured by Solenis) was added as a sizing agent and kept stirring for 1 minute, and subsequently 3.5 g of the water dispersion of Synthesis Example 1 diluted with water to a solid content of 10% was added and kept stirring for 1 minute.

The above pulp slurry was placed in a metal tank. In the lower part of the tank, a metal pulp mold with many suction holes was present with a reticular body placed on top of the mold. From the side opposite to the side where the reticular body of the pulp mold was placed, the pulp-containing aqueous composition was suctioned and dehydrated through the pulp mold and the reticular body using a vacuum pump, and the solids (such as a pulp) contained in the pulp-containing aqueous composition were deposited on the reticular body to obtain a molded pulp intermediate. Next, the resulting molded pulp intermediate was dried by applying pressure from top and bottom with metal male and female molds heated to 60 to 200° C. As a result, a molded pulp product molded into a container shape was produced. Table 1 shows the results of evaluating the content of each component based on the pulp in the resulting molded pulp product, as well as high-temperature oil-resistance and high-temperature water-resistance.

Example 2

The experiment was performed in the same manner as in Example 1, except that alkyl ketene dimer (AKD) was not added. Table 1 shows the results of evaluating the content of each component based on the pulp in the resulting molded pulp product, as well as high-temperature oil-resistance and high-temperature water-resistance.

Example 3

The experiment was performed in the same manner as in Example 1, except that the water dispersion of Synthesis Example 2 was used, Table 1 shows the results of evaluating the content of each component based on the pulp in the resulting molded pulp product, as well as high-temperature oil-resistance and high-temperature water-resistance.

Example 4

The experiment was performed in the same manner as in Example 3, except that 2 g of the water dispersion of Synthesis Example 2 diluted with water to a solid content of 10% was added, and 1.0 g of the amphoteric PAM diluted with water to a solid content of 10% was added. Table 1 shows the results of evaluating the content of each component based on the pulp in the resulting molded pulp product, as well as high-temperature oil-resistance and high-temperature water-resistance.

Example 5

The experiment was performed in the same manner as in Example 3, except that alkyl ketene dimer (AKD) was not added. Table 1 shows the results of evaluating the content of each component based on the pulp in the resulting molded pulp product, as well as high-temperature oil-resistance and high-temperature water-resistance.

Example 6

The experiment was performed in the same manner as in Example 4, except that alkyl ketene dimer (AKD) was not added. Table 1 shows the results of evaluating the content of each component based on the pulp in the resulting molded pulp product, as well as high-temperature oil-resistance and high-temperature water-resistance.

Example 7

The experiment was performed in the same manner as in Example 1, except that the water dispersion of Synthesis Example 3 was used. Table 1 shows the results of evaluating the content of each component based on the pulp in the resulting molded pulp product, as well as high-temperature oil-resistance and high-temperature water-resistance.

Example 8

The experiment was performed in the same manner as in Example 3, except that the water dispersion of Synthesis Example 4 was used. Table 1 shows the results of evaluating the content of each component based on the pulp in the resulting molded pulp product, as well as high-temperature oil-resistance and high-temperature water-resistance.

Example 9

The experiment was performed in the same manner as in Example 8, except that alkyl ketene dimer (AKD) was not added. Table 1 shows the results of evaluating the content of each component based on the pulp in the resulting molded pulp product, as well as high-temperature oil-resistance and high-temperature water-resistance.

Comparative Example 1

The experiment was performed in the same manner as in Example 1, except that the water dispersion of Comparative Synthesis Example 1 was used. Table 1 shows the results of evaluating the content of each component based on the pulp in the resulting molded pulp product, as well as high-temperature oil-resistance and high-temperature water-resistance.

Comparative Example 2

The experiment was performed in the same manner as in Example 1, except that the water dispersion of Comparative Synthesis Example 2 was used. Table 1 shows the results of evaluating the content of each component based on the pulp in the resulting molded pulp product, as well as high-temperature oil-resistance and high-temperature water-resistance.

TABLE 1

| | | | Example 1 Synthesis Example 1 | Example 2 Synthesis Example 1 | Example 3 Synthesis Example 2 | Example 4 Synthesis Example 2 | Example 5 Synthesis Example 2 | Example 6 Synthesis Example 2 |
|---|---|---|---|---|---|---|---|---|
| Formulation | Copolymer Monomer (part by weight) | Stearic acid amide-ethyl acrylate | 90 | 90 | 90 | 90 | 90 | 90 |
| | | 4-Hydroxybutyl acrylate | 7 | 7 | 7 | 7 | 7 | 7 |
| | | Dimethylaminoethyl methacrylate | 3 | 3 | 3 | 3 | 3 | 3 |
| | Emulsifier | Cationic emulsifier | ✓ | ✓ | ✓ | ✓ | ✓ | ✓ |
| | | Nonionic emulsifier | | | ✓ | ✓ | ✓ | ✓ |

TABLE 1-continued

| | | | Example 1 Synthesis Example 1 | Example 2 Synthesis Example 1 | Example 3 Synthesis Example 2 | Example 4 Synthesis Example 2 | Example 5 Synthesis Example 2 | Example 6 Synthesis Example 2 |
|---|---|---|---|---|---|---|---|---|
| | Initiator | Organic peroxide | | | | | | |
| | | Azo group-containing water-soluble initiator | ✓ | ✓ | ✓ | ✓ | ✓ | ✓ |
| Amount used | Sizing agent | Solid content (%) | 0.15 | 0 | 0.15 | 0.15 | 0 | 0 |
| | Oil-resistant agent | Solid content (%) | 3.5 | 3.5 | 3.5 | 2 | 3.5 | 2 |
| | Amphoteric PAM | | | | | ✓ | | ✓ |
| Softening point | Temperature (° C.) | | 91 | 91 | 91 | 91 | 91 | 91 |
| Performance Evaluation | High-temperature oil resistance | 65° C. × 45 min | 4 | 4 | 4 | 4 | 4 | 4 |
| | | 80° C. × 30 min | 4 | 4 | 4 | 4 | 4 | 4 |
| | High-temperature water resistance | 100° C. × 30 min | 4 | 4 | 4 | 4 | 4 | 4 |

| | | | | Example 7 Synthesis Example 3 | Example 8 Synthesis Example 4 | Example 9 Synthesis Example 4 | Comparative Example 1 Comparative Synthesis Example 1 | Comparative Example 2 Comparative Synthesis Example 2 |
|---|---|---|---|---|---|---|---|---|
| | Formulation | Copolymer Monomer (part by weight) | Stearic acid amide-ethyl acrylate | 90 | 90 | 90 | 78 | 78 |
| | | | 4-Hydroxybutyl acrylate | 7 | 7 | 7 | 16 | 16 |
| | | | Dimethylaminoethyl methacrylate | 3 | 3 | 3 | 6 | 6 |
| | | Emulsifier | Cationic emulsifier | | ✓ | ✓ | ✓ | |
| | | | Nonionic emulsifier | | ✓ | ✓ | | |
| | | Initiator | Organic peroxide | ✓ | | | | ✓ |
| | | | Azo group-containing water-soluble initiator | | ✓ | ✓ | ✓ | |
| | Amount used | Sizing agent | Solid content (%) | 0.15 | 0.15 | 0 | 0.15 | 0.15 |
| | | Oil-resistant agent | Solid content (%) | 3.5 | 3.5 | 3.5 | 3.5 | 3.5 |
| | | Amphoteric PAM | | | | | | |
| | Softening point | Temperature (° C.) | | 78 | 91 | 91 | 93 | 72 |
| | Performance Evaluation | High-temperature oil resistance | 65° C. × 45 min | 3 | 4 | 4 | 0 | 0 |
| | | | 80° C. × 30 min | 3 | 4 | 4 | 0 | 0 |
| | | High-temperature water resistance | 100° C. × 30 min | 4 | 4 | 4 | 0 | 0 |

Industrial Applicability

The polymer and oil-resistant composition of the present disclosure is applicable to paper, and in particular a food container and a food packaging material.

Preferable embodiments of the present disclosure are as follows:

Embodiment 1

An oil-resistant composition comprising a hydrocarbon group-containing polymer having a repeating unit formed from a monomer having a hydrocarbon group having 1 to 40 carbon atoms and an NH group-containing group in an amount of 80% by weight or more based on the polymer.

Embodiment 2

The oil-resistant composition according to embodiment 1, wherein the hydrocarbon group-containing polymer is polyolefin, polyacrylic, polyester, polyamide, polycarbonate, or polyurethane in which the NH group-containing group is present between a polymer main chain and the hydrocarbon group.

Embodiment 3

The oil-resistant composition according to embodiment 1 or 2, wherein the hydrocarbon group-containing polymer has a repeating unit formed from an ethylenic carbon-carbon double bond monomer having an NH group-containing group between a polymer main chain and the hydrocarbon group.

Embodiment 4

The oil-resistant composition according to any one of embodiments 1 to 3, wherein the hydrocarbon group-containing polymer has:

(a) a repeating unit formed from an acrylic monomer having a hydrocarbon group having 1 to 40 carbon atoms and an NH group-containing group, and (b) a repeating unit formed from an acrylic monomer having a hydrophilic group.

Embodiment 5

The oil-resistant composition according to embodiment 4, wherein the hydrocarbon group-containing polymer further has:

a repeating unit formed of a monomer having an ethylenic carbon-carbon double bond and an anion donating group or a cation donating group (c) other than the monomers (a) and (b).

Embodiment 6

The oil-resistant composition according to any one of embodiments 1 to 5, wherein the hydrocarbon group-containing polymer has a softening point of 80° C. or higher.

Embodiment 7

The oil-resistant composition according to any one of embodiments 1 to 6, wherein the hydrocarbon group-containing polymer is obtained by emulsion polymerization.

Embodiment 8

The oil-resistant composition according to any one of embodiments 1 to 7, further comprising at least one emulsifier selected from a cationic emulsifier, a nonionic emulsifier, and an anionic emulsifier.

Embodiment 9

The oil-resistant composition according to any one of embodiments 5 to 8, wherein an amount of the repeating unit formed of the acrylic monomer having a hydrocarbon group (a) is 80 to 99% by weight based on the polymer, an amount of the repeating unit formed of the acrylic monomer having a hydrophilic group (b) is 1 to 15% by weight based on the polymer, and an amount of the repeating unit formed of the monomer having an anion donating group or a cation donating group (c) is 0 to 20% by weight based on the polymer.

Embodiment 10

The oil-resistant composition according to any one of embodiments 1 to 9, further comprising a liquid medium that is water or a mixture of water and an organic solvent.

Embodiment 11

Oil-resistant paper to which the hydrocarbon group-containing polymer in the oil-resistant composition according to any one of embodiments 1 to 10 adheres.

Embodiment 12

The oil-resistant paper according to embodiment 11, which is a molded pulp product.

Embodiment 13

The oil-resistant paper according to embodiment 11 or 12, which is a food packaging material or a food container.

Embodiment 14

A method for producing paper, comprising treating paper with the oil-resistant composition according to any one of embodiments 1 to 10 through external treatment or internal treatment.

Embodiment 15

The production method according to embodiment 14, wherein a pulp slurry has an electrical conductivity of 0.1 to 2,000 μS/cm and a pH of 4 to 9, and hardness of water used in the pulp slurry is 5,000 ppm or less.

Embodiment 16

A method for producing molded pulp, comprising filling a mold with the oil-resistant composition according to any one of embodiments 1 to 10 and a pulp slurry, and molding pulp by allowing water to permeate to the outside of the mold.

What is claimed is:

1. A paper oil-resistant agent composition comprising:

a liquid medium that is water or a mixture of water and an organic solvent; and a hydrocarbon group-containing polymer having a repeating unit formed from a monomer (a) in an amount of 80% by weight or more based on the polymer, wherein the monomer (a) is an amide group-containing monomer represented by formula:

$$R^{12}—C(=O)—NH—R^{13}—O—R^{11}$$

wherein $R^{11}$ is an organic residue having an ethylenically unsaturated polymerizable group, $R^{12}$ is a hydrocarbon group having 7 to 40 carbon atoms, and $R^{13}$ is a hydrocarbon group having 1 to 5 carbon atoms.

2. The paper oil-resistant agent composition according to claim 1, wherein the hydrocarbon group-containing polymer has:

(b) a repeating unit formed from an acrylic monomer having a hydrophilic group.

3. The paper oil-resistant agent composition according to claim 2, wherein the hydrocarbon group-containing polymer further has:

a repeating unit formed of a monomer having an ethylenic carbon-carbon double bond and an anion donating group or a cation donating group (c) other than the monomers (a) and (b).

4. The paper oil-resistant agent composition according to claim 1, wherein the hydrocarbon group-containing polymer has a softening point of 80° C. or higher.

5. The paper oil-resistant agent composition according to claim 1, wherein the hydrocarbon group-containing polymer is obtained by emulsion polymerization.

6. The paper oil-resistant agent composition according to claim 1, further comprising at least one emulsifier selected from a cationic emulsifier, a nonionic emulsifier, and an anionic emulsifier.

7. The paper oil-resistant agent composition according to claim 2, wherein an amount of the repeating unit formed of the acrylic monomer having a hydrocarbon group (a) is 80 to 99% by weight based on the polymer, an amount of the repeating unit formed of the acrylic monomer having a hydrophilic group (b) is 1 to 15% by weight based on the polymer, and an amount of a repeating unit formed of the monomer having an anion donating group or a cation donating group (c) other than the monomers (a) and (b) is 0 to 20% by weight based on the polymer.

8. The paper oil-resistant agent composition according to claim 1, which is for internal treatment.

9. Oil-resistant paper to which the hydrocarbon group-containing polymer in the paper oil-resistant agent composition according to claim 1 adheres.

10. The oil-resistant paper according to claim 9, which is a molded pulp product.

11. The oil-resistant paper according to claim 9, which is a food packaging material or a food container.

12. A method for producing paper, comprising treating paper with the paper oil-resistant agent composition according to claim 1 through external treatment or internal treatment.

13. A method for producing molded pulp, comprising filling a mold with the paper oil-resistant agent composition according to claim 1 and a pulp slurry, and molding pulp by allowing water to permeate to an outside of the mold.

* * * * *